US006212970B1

(12) United States Patent
Bortolon

(10) Patent No.: US 6,212,970 B1
(45) Date of Patent: Apr. 10, 2001

(54) PEDAL ASSEMBLY WITH ADJUSTABLE PAD

(75) Inventor: Christopher A. Bortolon, Clawson, MI (US)

(73) Assignee: Teleflex Incorporated, Plymouth Meeting, PA (US)

( * ) Notice: Subject to any disclaimer, the term of this patent is extended or adjusted under 35 U.S.C. 154(b) by 0 days.

(21) Appl. No.: 09/382,713

(22) Filed: Aug. 24, 1999

(51) Int. Cl.[7] ..... G05G 1/20
(52) U.S. Cl. ..... 74/512; 74/560
(58) Field of Search ..... 74/512, 560, 513

(56) References Cited

U.S. PATENT DOCUMENTS

| | | | | |
|---|---|---|---|---|
| 3,151,499 | | 10/1964 | Roe . | |
| 3,563,111 | | 2/1971 | Zeigler . | |
| 3,643,524 | | 2/1972 | Herring . | |
| 5,306,136 | | 4/1994 | Oomori et al. . | |
| 5,329,657 | | 7/1994 | Bartley et al. . | |
| 5,697,260 | * | 12/1997 | Rixon | 74/513 |
| 5,884,532 | | 3/1999 | Rixon et al. . | |
| 6,019,015 | * | 2/2000 | Elton | 74/512 |

OTHER PUBLICATIONS

IBM Technical Disclosure Bulletin vol. 10, No. 8, Jan. 1968.

* cited by examiner

*Primary Examiner*—David A. Bucci
*Assistant Examiner*—Vicky H. Johnson
(74) *Attorney, Agent, or Firm*—Howard & Howard

(57) ABSTRACT

An adjustable pedal assembly (12) includes a mounting bracket (14) for attachment to a vehicle structure (16), a pedal lever (18), a pedal pad (26), and a driving mechanism (28). The pedal lever (18) has an upper end (22) and a lower end (24) with the upper end (22) being pivotally supported with respect to the mounting bracket (14). The pedal pad (26) is connected to the lower end (24) of the pedal lever (18) and the driving mechanism (28) is operative to move the pedal pad (26) between an extended position and a retracted position. The assembly is characterized by including a control linkage (30) interconnecting the driving mechanism (28) and the pedal pad (26). The driving mechanism (28) drives the control linkage (30) along a guide path defined by the pedal lever (18) to move the pedal pad (26) between the extended and retracted positions. The control linkage (30) is comprised of a first pair of link members (52, 54) mounted on one side of the pedal lever (18) and a second pair of link members (52, 54) mounted on an opposite side of the pedal lever (18). Each pair of link members (52, 54) includes a common pivotal connection (72) that creates a scissor motion on each side of the pedal Lever (18) as the driving mechanism (28) moves the pedal pad (26) between retracted and extended positions.

18 Claims, 3 Drawing Sheets

FIG-1
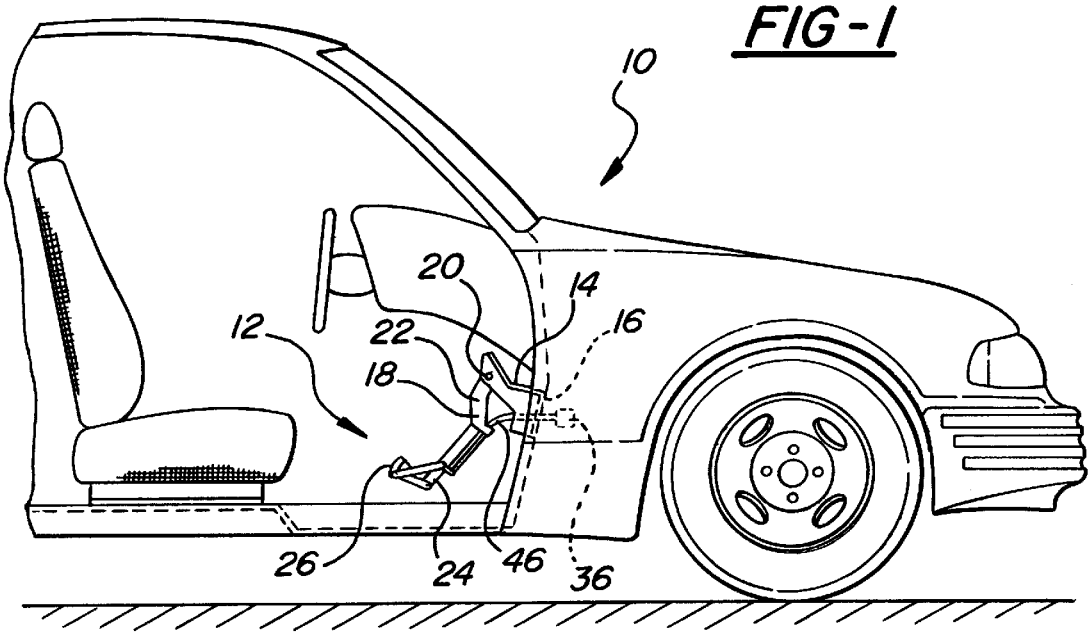
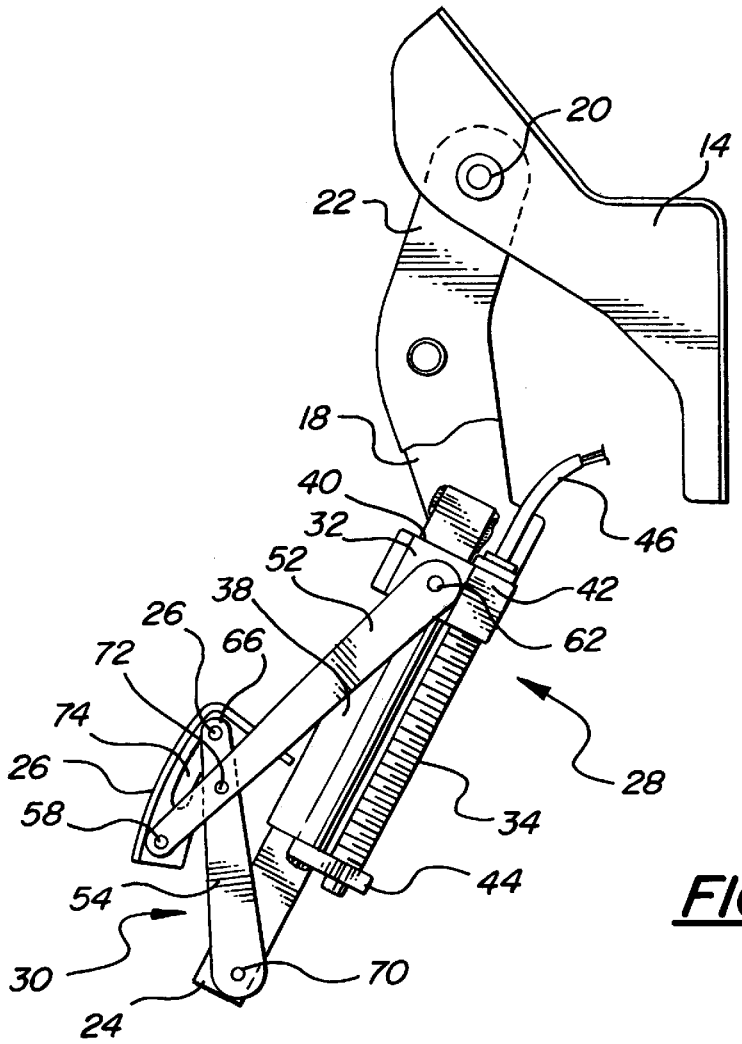
FIG-2

PEDAL ASSEMBLY WITH ADJUSTABLE PAD

TECHNICAL FIELD

The subject invention relates to an adjustable pedal assembly of the type attached to an automotive vehicle to control the brake, clutch and/or throttle in normal operation but which can be adjusted to a different position to accommodate a different driver position.

BACKGROUND OF THE INVENTION

Pedal assemblies are provided in vehicles to control brakes, engine throttles, and/or clutches. Typically, these pedals include a lever arm pivotally mounted to a mounting bracket and a pedal pad mounted to a lower end of the lever arm. These pedals are foot operated by the driver. In order for the driver to maintain the most advantageous position for working the control pedals, the vehicle front seat is usually slidably mounted on a seat track and can be moved forwardly or rearwardly between several adjusted positions.

The adjustment provided by moving the seat does not accommodate all vehicle drivers due to differences in anatomical dimensions. Another concern involves the placement of a vehicle driver too close to the steering wheel when the seat is adjusted in a forward position, which could result in injury to a driver from an exploding airbag. Further, some vehicles do not have seats with seat tracks and thus, require another method for placing the pedals in the most advantageous position for the driver.

Various proposals have been made to provide selective adjustment of pedal positions to accommodate various size drivers. Selective pedal adjustment can be accomplished by moving the entire lever arm in forward and rearward directions, or can be accomplished by moving the pedal pad in forward and rearward directions with respect to the lever arm. Examples of an adjustable pedal assemblies are shown in U.S. Pat. Nos. 3,151,499 to Roe, 3,563,111 to Zeigler, and 3,643,524 to Herring. Adjustable pedal assemblies are often complex, difficult to package, and expensive. Additionally, they can be difficult to assemble and operate.

Thus, it would be desirable to have a simplified adjustable pedal assembly that is less expensive, easy to operate, requires less packaging space, and which is easily assembled.

SUMMARY OF THE INVENTION AND ADVANTAGES

An adjustable pedal assembly includes a mounting bracket for attachment to a vehicle structure and a pedal lever having an upper end and a lower end. The upper end of the pedal lever is pivotally supported with respect to the mounting bracket. The assembly also includes a pedal pad that is connected to the lower end of the pedal lever and a driving mechanism that is operative to move the pedal pad between an extended position and a retracted position. The assembly is characterized by including a control linkage interconnecting the driving mechanism and the pedal pad wherein the driving mechanism drives the control linkage along a guide path defined by the pedal lever to move the pedal pad between the extended and retracted positions.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a side view of the subject adjustable pedal assembly as installed in a vehicle.

FIG. 2 is side view of the subject adjustable pedal assembly in the fully retracted position.

DETAILED DESCRIPTION OF THE PREFERRED EMBODIMENT

Figure 3:
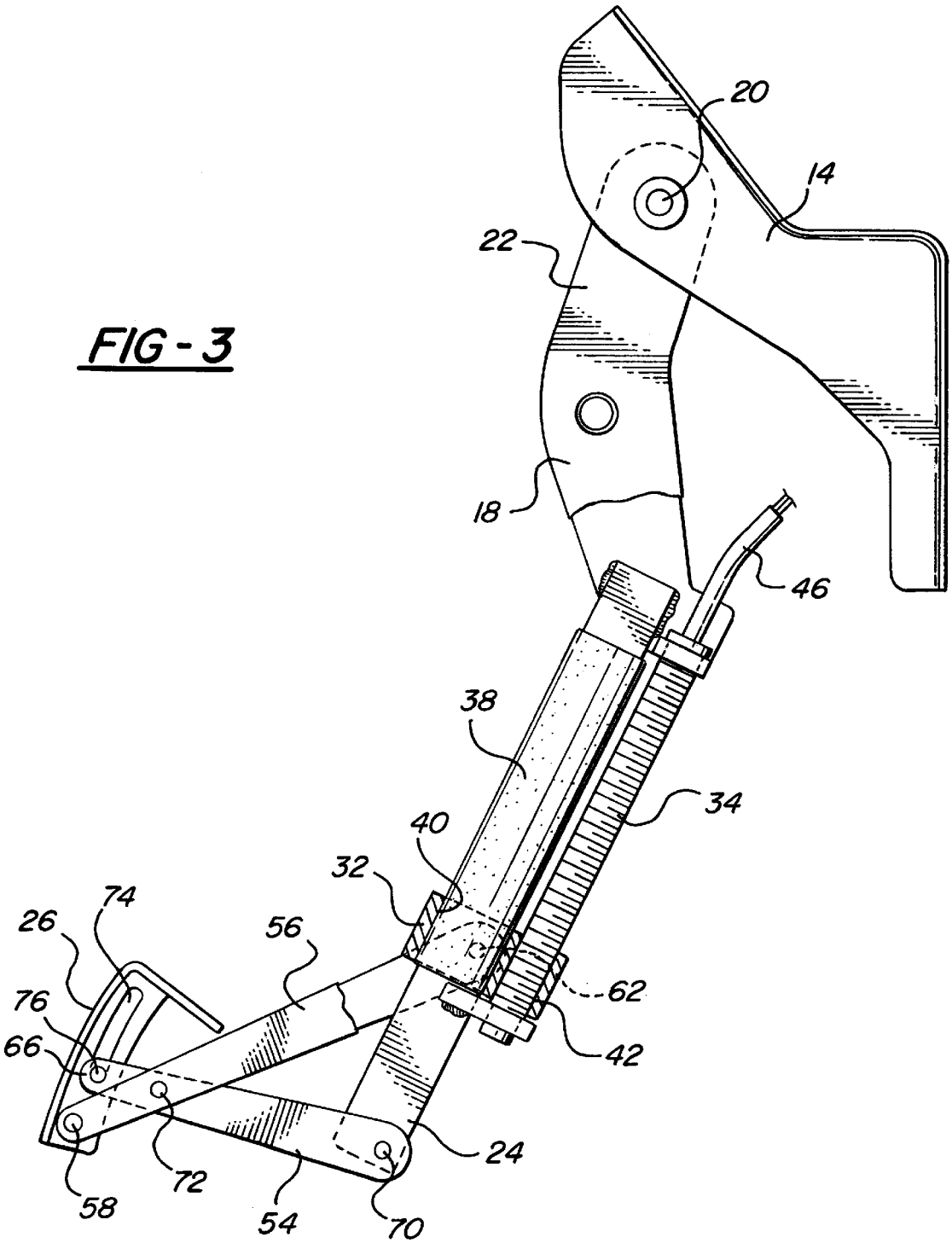
FIG. 3 is a side view of the adjustable pedal assembly of FIG. 1 in the fully extended position.

Referring to the Figures, wherein like numerals indicate like or corresponding parts throughout the several views, a vehicle is shown generally at 10 in FIG. 1. The vehicle includes an adjustable pedal assembly shown generally at 12. The adjustable pedal assembly includes a mounting bracket 14 that is attached to a vehicle structure 16 as is known in the art. A pedal lever 18 is pivotally mounted with respect to the bracket 14 such that a vehicle driver can move the lever 18 from a rest position to an applied position. Typically, the lever 18 is mounted to the bracket 14 on a pivot shaft 20, however, other mounting methods known in the art could also be used.

The pedal lever 18 includes an upper end 22 and a lower end 24. A pedal pad 26 is connected to the lower end 24 of the pedal lever 18. The driver applies his foot against the pedal pad 26 to move the lever 18 from the rest to the applied position. The lever 18 is typically connected to a vehicle control system (not shown) such as the braking, engine throttle, or clutch system. This control connection can be accomplished mechanically with cables, or can be done electronically.

As shown in FIG. 2, the pedal assembly 12 includes a driving mechanism 28 that is operative to adjust the position of the pedal pad 26 between an extended position and a retracted position. A control linkage assembly, shown generally at 30, interconnects the driving mechanism 28 and pedal pad 26. The driving mechanism 28 drives the control linkage assembly 30 along a guide path that is defined by the pedal lever 18 to move the pedal pad 26 between the extended and retracted positions. FIG. 2 shows the pedal pad 26 in a fully retracted position and FIGS. 3 and 4 show the pedal pad 26 in a fully extended position.

Figure 4:
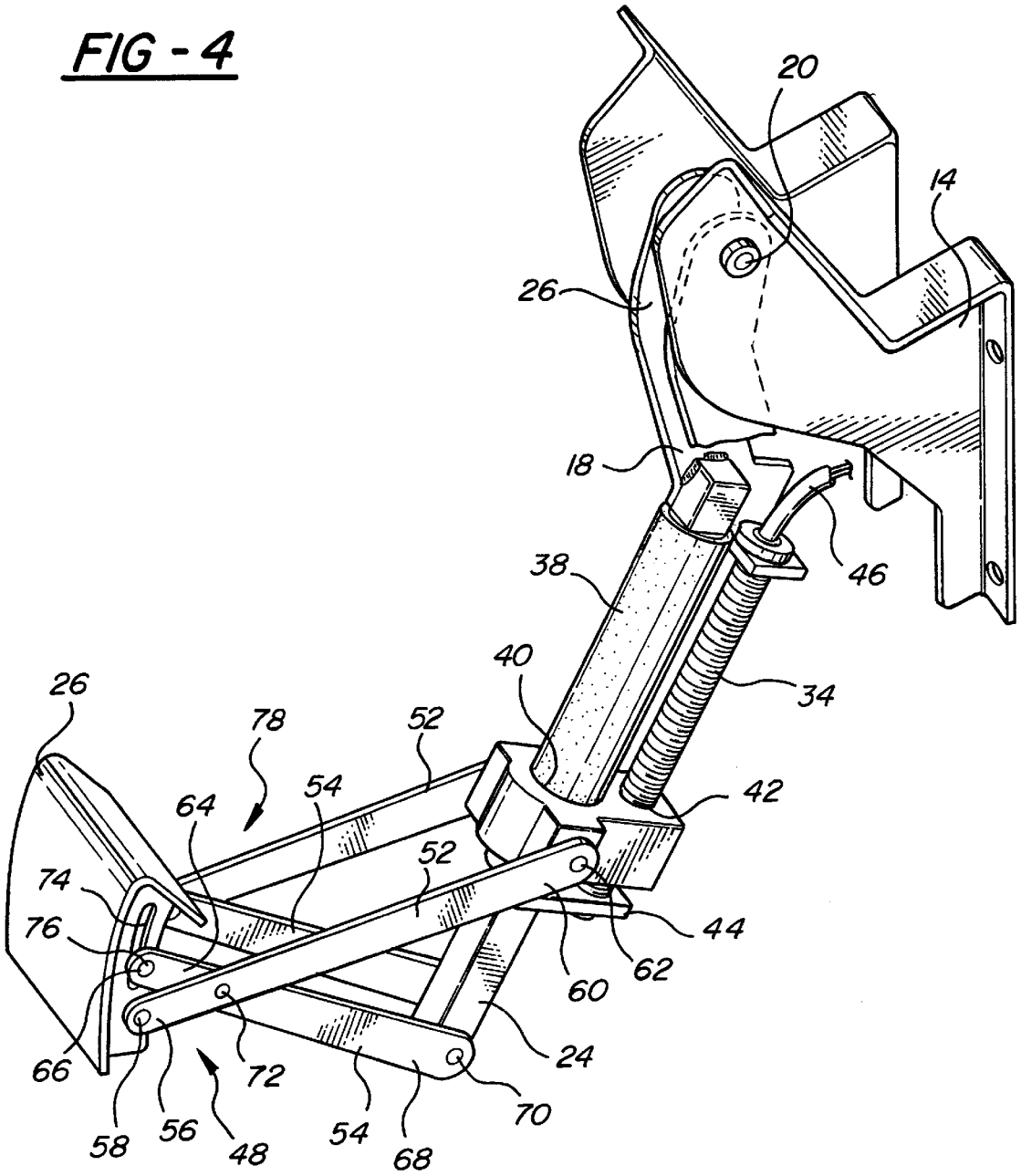
FIG. 4 is a perspective view of the assembly shown in FIG. 3.

As shown in FIGS. 2 and 3, the driving mechanism 28 is preferably mounted to the lever 18 and includes a drive nut 32 and a screw shaft 34. A drive motor 36 (see FIG. 1) is used to drive the screw shaft 34, which causes the nut 32 to move up and down the shaft 34. The lever 18 includes a smooth guide rod portion 38 that defines the guide path. The guide rod portion 38 extends along the length of the lever 18. The drive nut 32 includes a smooth bore 40 that slidably receives the guide rod portion 38 and a threaded bore 42 that engages the externally threaded surface of the screw shaft 34.

The screw shaft 34 is preferably mounted such that it is parallel to the guide rod portion 38. A support plate 44 mounts one end of the screw shaft 34 to the lever 18 and provides additional support for the shaft 34. A wire connection 46 extends from the screw shaft 34 to the motor 36.

As the motor 36 rotates the screw shaft 34, the drive nut 32 is driven up and down the guide rod portion 38 of the lever 18. As the nut 32 moves from an upper position, shown in FIG. 2, to a lower position, shown in FIG. 2, the control linkage assembly 30 extends the pedal pad 26 outwardly, away from the lever 18. Thus, as the nut 32 is driven in a generally vertical direction, the pedal pad 26 is adjusted in a generally horizontal direction.

As shown in FIG. 4, the control linkage assembly 30 is comprised of a plurality of link members. The control linkage assembly 30 includes a first linkage assembly 48 and a second linkage assembly 78. The first linkage assembly 48 includes a first link member 52 and a second link member 54. The first link member 52 has one end 56 that is fixed to the pedal pad 26 at a first connection 58 and another end 60 that is fixed to the drive nut 32 at a second connection 62. The second link member has one end 64 that is movably supported with respect to the pedal pad 26 at a third connection 66 and another end 68 that is fixed to a lower end 24 of the pedal lever 18 at a fourth connection 70.

The first 52 and second 54 link members are pivotally connected to each other at a fifth connection 72 that is between the lever 18 and the pedal pad 26. Preferably, the fifth connection 72 is positioned between the first 58 and second 52 connections and between the third 66 and fourth 70 connections. The fifth pivotal connection 72 between the link members 52, 54 creates a scissor type motion when the drive nut 32 is driven up and down the screw shaft 34. To create this scissors motion, the fourth connection 70 remains fixed and the first 58, second 62, and third 66 connections move relative to the fourth connection 70. The second connection 62 moves only in a linear direction up and down the guide rod portion 38. The first connection 58 rotates about the second connection 72 and the third connection 66 rotates about the fourth connection 70.

The pedal pad 26 includes at least one slot 74 that receives a guide pin 76 to form the third connection 66. The drive motor 36 rotates the screw shaft 34 causing the drive nut 32 to move downwardly along the lever 18. As the nut 32 moves downwardly it also moves the first link member 52 downwardly causing the pedal pad 26 to extend. As the pedal pad 26 extends, the end 64 of the second link member 54 that is connected to the guide pin 76 slides downwardly in the slot 74 until it reaches the bottom of the slot 74 and the pedal pad 26 is in the fully extended position.

The control linkage assembly 30 also preferably includes a second linkage assembly 78 that is comprised of basically the same components as the first linkage assembly 48. The first linkage assembly 48 is mounted on one side of the pedal lever 18 and the second linkage assembly 78 is mounted on an opposite side of the pedal lever 18. The linkage assemblies 48, 78 work in unison to move the pedal pad 26 between the fully retracted and extended positions. The pedal pad 26 includes a corresponding slot 74 in the opposite side of the pedal pad 26 and the guide pin 76 extends between the first ends 64 of the second link members 54 of each linkage assembly 48, 78. While two linkage assemblies 48, 78 are preferred, it should be understood that the pedal pad 26 could also be adjusted with a single linkage assembly. Two linkage assemblies are preferred to provide sufficient support for the pedal pad 26.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An adjustable pedal assembly (12) comprising:

a mounting bracket (14) for attachment to a vehicle structure (16);

a pedal lever (18) having an upper end (22) and a lower end (24), said upper end (22) being pivotally supported with respect to said mounting bracket (14);

a pedal pad (26);

a driving mechanism (28) operatively connecting said pedal pad (26) for moving said pedal pad (26) relative to said pedal lever (18) between an extended position and a retracted position;

said assembly characterized by said driving mechanism (28) being supported by and movable along said pedal lever (18) and a control linkage (30) interconnecting said driving mechanism (28) and said pedal pad (26) for moving said pedal pad (26) between said extended and retracted positions in response to movement of said driving mechanism (28) along said along said pedal lever (18).

2. An assembly as set forth in claim 1 wherein said control linkage (30) is comprised of a first linkage (52) and a second linkage (54), said first linkage (52) having a first connection (58) to said pedal pad (26) and a second connection (62) to said driving mechanism (28) and said second linkage (52) having a third connection (66) to said pedal pad (26) and a fourth connection (70) to said lower end (24) of said pedal lever (18).

3. An assembly as set forth in claim 2 wherein said first connection (58) is fixed for movement with said pedal pad (26), said second (62) connection is fixed for movement with said driving mechanism (28), said third connection (66) is mounted for movement relative to said pedal pad (26), and said fourth connection (70) is fixed to said lower end (24) of said pedal lever (18).

4. An assembly as set forth in claim 3 wherein said first linkage (52) is pivotally connected to said second linkage (54) at a fifth connection (72).

5. An assembly as set forth in claim 4 wherein said fifth connection (72) is positioned between said first (58) and second (62) connections and between said third (66) and fourth (70) connections.

6. An assembly as set forth in claim 2 wherein said driving mechanism (28) includes a drive nut (32) slidably supported with respect to said pedal lever (18), a screw shaft (34) in driving engagement with said drive nut (32), and a motor (36) for driving said screw shaft (34).

7. An assembly as set forth in claim 6 wherein said pedal lever (18) includes a smooth guide rod portion (38), said drive nut (32) having a smooth bore (40) for receiving said guide rod portion (38) and a threaded bore (42) for receiving said screw shaft (34).

8. An assembly as set forth in claim 7 wherein said guide rod portion (38) extends along the length of said pedal lever (18).

9. An assembly as set forth in claim 8 wherein said screw shaft (34) is mounted parallel to said guide rod portion (38).

10. An assembly as set forth in claim 6 wherein said pedal pad (26) includes at least one slot (74) for receiving said third connection (66).

11. An assembly as set forth in claim 10 wherein said first linkage (52) includes first and second link members, said first connection (58) comprising an attachment of a lower portion (56) of each of said first and second link members to opposing sides of said pedal pad (26) and said second connection (62) comprising an attachment of an upper portion (60) of each of said first and second link members to opposing sides of said drive nut (32), and wherein said second linkage (54) includes third and fourth link members, said third connection (66) comprising a guide pin (76) extending between a first end portion (64) of each of said third and fourth link members and movably supported in said slot (74) and said fourth connection (70) comprising an attachment of a second end portion (68) of each of said third and fourth link members to opposing sides of said pedal lever (18).

12. An assembly as set forth in claim 2 wherein said fourth connection (70) remains fixed and said first (58), second (62), and third (66) connections move relative to said fourth connection (70).

13. An adjustable pedal apparatus (12) comprising:

a mounting bracket (14) for attachment to a vehicle structure (16);

a pedal lever (18) having an upper end (22) and a lower end (24), said upper end (22) being pivotally supported with respect to said mounting bracket (14);

a pedal pad (26);

a driving mechanism (28) including a drive motor (36), a drive nut (32), and a screw shaft (34), said drive motor (36) for driving said screw shaft (34) and drive nut (32) to move said pedal pad (26) between an extended position and a retracted position;

said apparatus characterized by said screw shaft (34) extending along said pedal lever (18) and a control linkage (30) connecting said driving mechanism (28) to said pedal pad (26) for moving said pedal pad (26) transversely to said pedal lever (18) in response to movement of said drive nut (32) along said screw shaft (34) in a direction parallel to said pedal lever (18).

14. An apparatus as set forth in claim 13 wherein said control linkage assembly (30) is comprised of a first link member (52) and a second link member (54), said first link member (52) extending from said drive nut (32) to said pedal pad (26) and said second link member (54) extending from said lower end (24) of said pedal lever (18) to said pedal pad (26).

15. An apparatus as set forth in claim 14 wherein said first (52) and second link (54) members are pivotally connected to each other at a point (72) between said pedal lever (18) and said pedal pad (26).

16. An apparatus as set forth in claim 15 wherein said pedal pad (26) includes at least one vertically extending slot (74) for guiding said second link (54) when said pedal pad (26) is moved between said extended and retracted positions.

17. An apparatus as set forth in claim 13 wherein said at least one control linkage (30) is comprised of a first control linkage assembly (48) connecting said driving mechanism (28) to said pedal pad (26) on one side of said pedal lever (18) and a second control linkage assembly (78) connecting said driving mechanism (28) to said pedal pad (26) on an opposite side of said pedal lever (18).

18. An apparatus as set forth in claim 17 wherein each of said first (48) and second (78) control linkage assemblies each include a first link member (52) and a second link member (54), said first link member (52) extending from said drive nut (32) to said pedal pad (26) and said second link member (54) extending from said lower end (24) of said pedal lever (18) to said pedal pad (26).

* * * * *